United States Patent [19]

Close

[11] 4,095,507

[45] Jun. 20, 1978

[54] COMBAT FIREARM

[76] Inventor: Ross A. Close, 3831 Glenbrook Rd., Fairfax, Va. 22031

[21] Appl. No.: 775,394

[22] Filed: Mar. 7, 1977

[51] Int. Cl.[2] ..... F41D 11/10

[52] U.S. Cl. ..... 89/129 B; 89/141; 89/142; 89/185; 89/191 R

[58] Field of Search ..... 89/185, 191 R, 129 B, 89/140, 141, 142

[56] References Cited

U.S. PATENT DOCUMENTS

| | | | |
|---|---|---|---|
| 3,345,914 | 10/1967 | Newcomb et al. | 89/129 B |
| 3,424,053 | 1/1969 | Close | 89/185 |

*Primary Examiner*—Stephen C. Bentley

[57] ABSTRACT

This invention relates to firearms of the type disclosed in my prior U.S. Pat. No. 3,424,053, granted Jan. 28, 1969, in which the principal parts such as actuating sleeve, receiver, frame and breechblock are made from cylindrical extruded metal tubing and metal rods. The combination of a cylindrical actuating sleeve, breechblock, frame, receiver, floating power cylinder, ratchet counter firing mechanism and other incidental parts are used to form a new action for automatic firearms.

This new action consists of a cylindrical sleeve carrying a floating power cylinder and functioning as an extractor port seal, breechblock stop and to actuate the ratchet firing counter. The above-mentioned parts and the breechblock lend themselves to manufacture by the use of automatic lathes and screw machines.

The use of an actuating sleeve and floating power cylinder results in a favorable mass ratio, which results in a reliable firearm.

1 Claim, 5 Drawing Figures

COMBAT FIREARM

DETAILED SPECIFICATIONS

Figure 1:
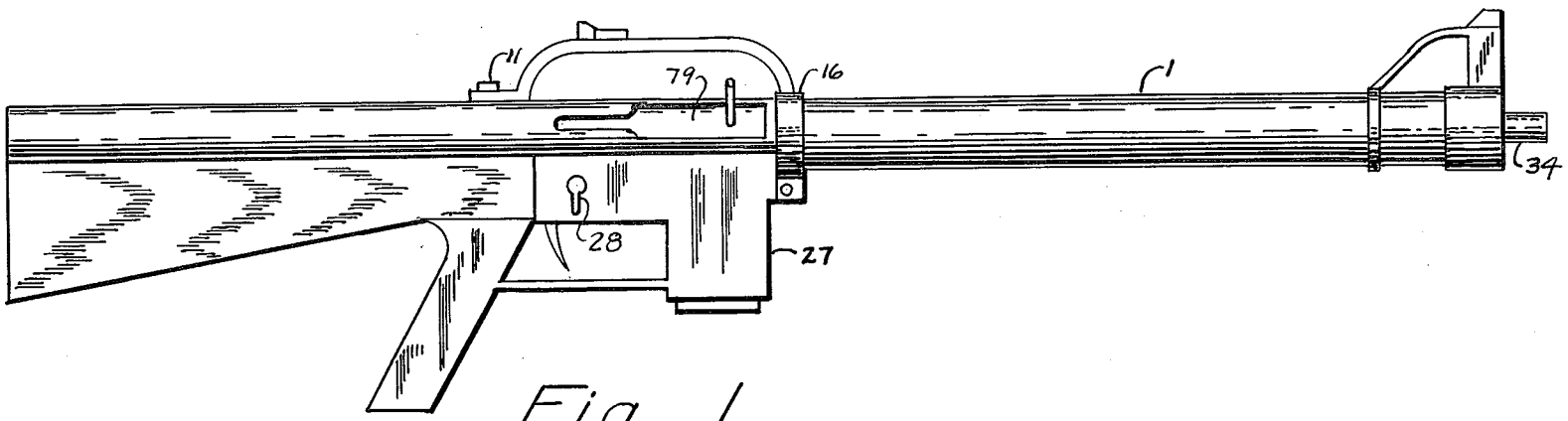
FIG. 1 of the drawings shows the new action as it would be used in the manufacture of a combat rifle.
Figure 2:
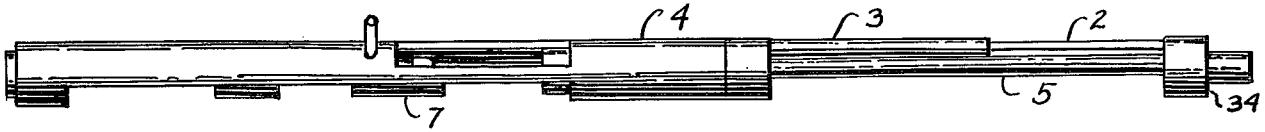
FIG. 2 is a side view of the receiver, and barrel mounted concentrically inside the actuating sleeve when floating power cylinder, the actuating sleeve is open position showing the exterior port exposed.
Figure 3:
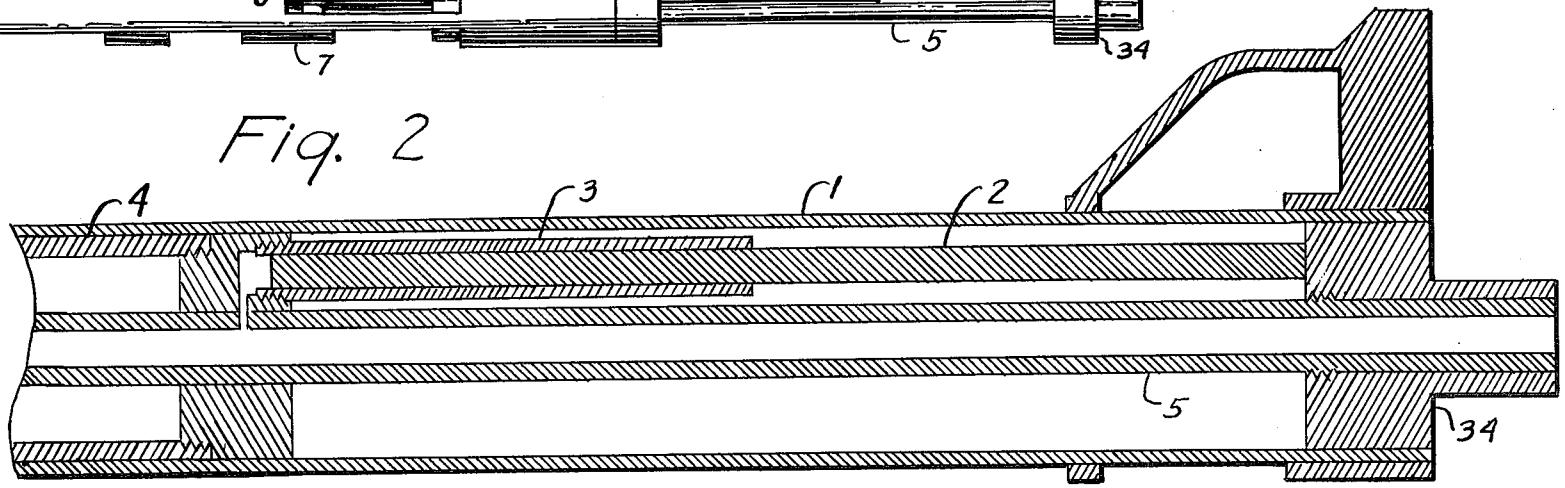
FIG. 3 is a partial longitudinal section through the actuating sleeve and shows the location of the various parts of the floating power cylinder when the action is closed.
Figure 4:
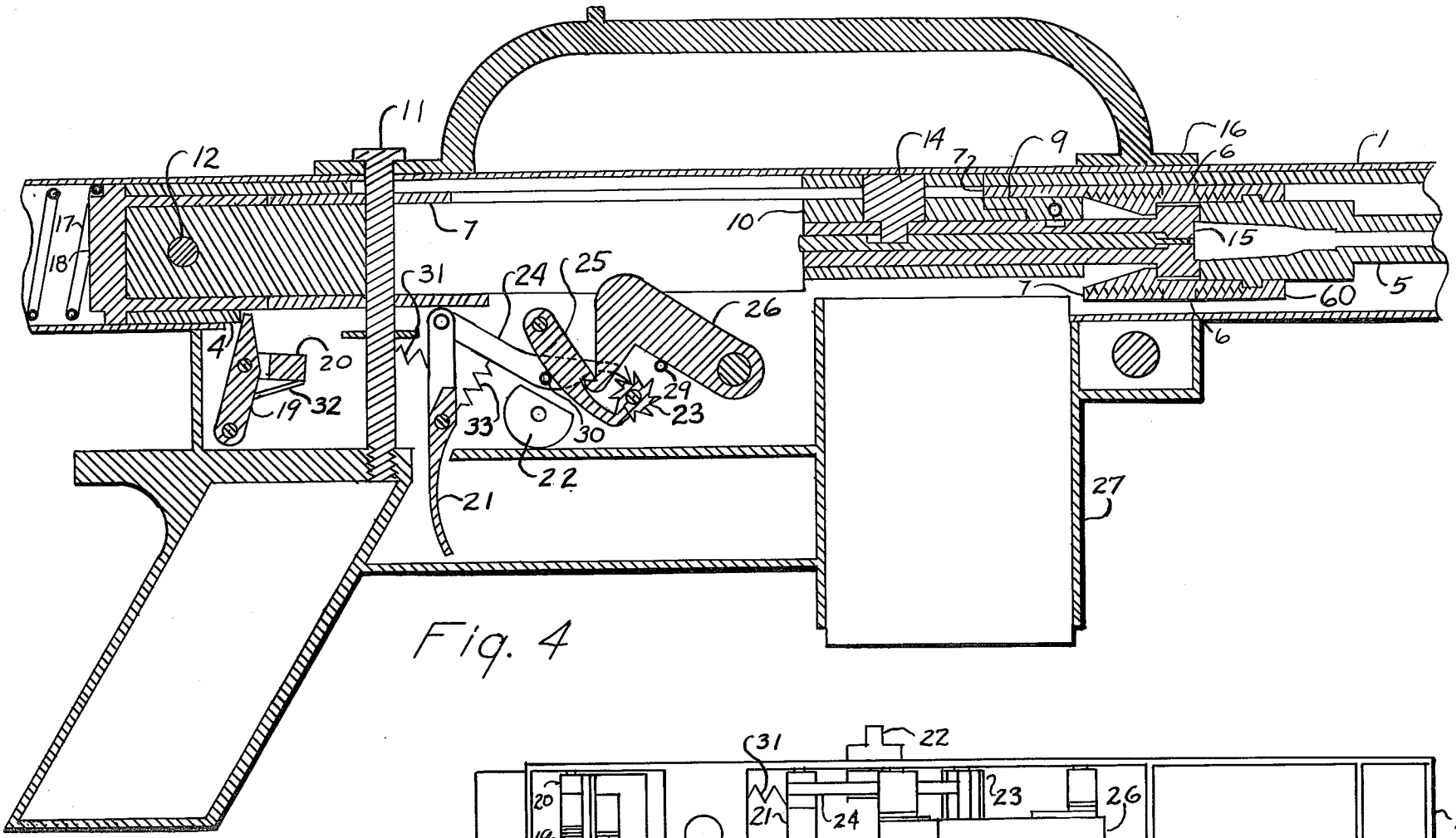
FIG. 4 is a longitudinal section of the new action and shows the relative position of the various parts when the action is closed.
Figure 5:
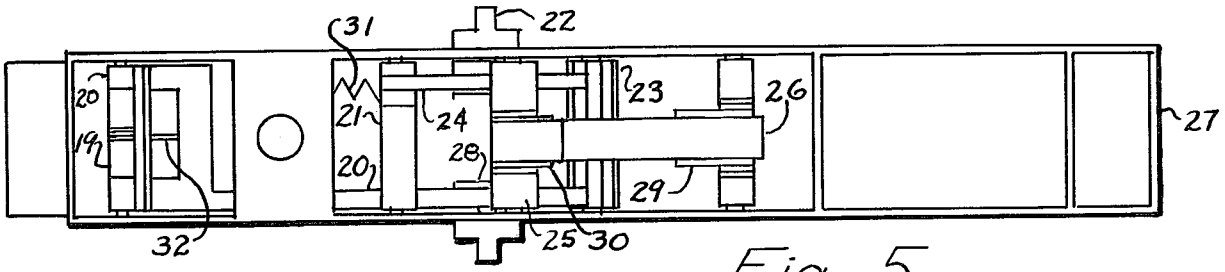
FIG. 5 is a top view of the firing mechanism showing the location of the firing pawls in relation to other parts.

This new action consists of new parts as follows:

1. Floating power cylinder for actuating cylindrical sleeve,

2. A new floating cam pin connecting the breech block, breech block guiding rod and actuating sleeve, 3. A ratchet counter firing mechanism.

The receiver shall be made in three parts, 6, 7 and 60. The barrel end 6 of the receiver shall be made of high strength steel, outside threaded to take second part of the receiver 7, and connected to the barrel 5 by a threaded collar 60. Two or more lugs are cut in this first part 6. These lugs are to bear on lugs of the breech block in order to support the shell at time of firing. The second part 7 of the receiver shall be made from cylindrical metal tubing. Cuts in this second part 7 shall be made to accommodate magazine, assembly pin 11, bolt catch 9, extractor port, cam pin 14, etc.

The breech block shall be made in two parts 15 and 10. The first part 15 shall consist of the locking lugs, firing pin, cam and extractor. The second part shall consist of the guiding rod 10 and bolt catch 9. The first part 15 shall be made from a high strength steel bar. Cuts shall be made for two or more locking lugs, firing pin, extractor, cam, etc. The second part 10 shall be made from cylindrical bar of metal. Cuts shall be made for the assembly pin 11, firing pin, bolt catch 9, pin 12, floating cam pin 14, and the magazine.

The actuating sleeve shall be made in two parts 3 and 4. The first part 3 shall be made from a cylindrical steel bar, fitted concentrically around the barrel, the power cylinder is fastened off center so as to allow the cylindrical sleeve to pass around the barrel, threaded at the other end to connect to the second part 4. The second part 4 of the actuating sleeve shall be made from cylindrical metal tubing. Cuts shall be made in the second part in such a way that when the action is closed the extractor port 79 is closed and when the action is open the extractor port 79 is open. Cuts shall be me in the second part 4 for the assembly pin 11, hammer 26, cam pin 14 and magazine. The power cylinder end of the second part 4 shall be threaded internally to fit the outside threads of part 3.

The frame shall be made in two parts. The first part, the cylindrical recoil frame 1 shall be made from cylindrical metal tubing. Cuts shall be made for the assembly pin 11, extractor port 79, hammer 26 and magazine. The second part 27 houses the hammer 26, the ratchet wheel 23, trigger 21, trigger pawl 24, ratchet 25, automatic pawl articulator 19, automatic pawl 20, trigger safety cam 22, automatic shutoff cam 28 and springs 29, 30, 31, 32 and 33. Part 1 of the frame and part 27 shall be fastened together by handle band 16 and bolt 11.

The floating cam pin 14 shall connect the two parts of the breech block 10 and 15 and the actuating sleeve 4 and retains the firing pin. Pin 12 shall connect actuating sleeve part 4, breech block part 10 and spring retainer 18.

The operation of this new automatic action is as follows:

This action is fired by rotating counter ratchet wheel 23. Pressing trigger 21 causes pawl 24 to rotate ratchet wheel 23. Ratchet wheel 23 moves ratchet 25 which releases hammer 26 striking firing pin which fires the shell. As instant of fire the breech block 15 is in such a position that lugs on breech block 15 are bearing on the lugs in receiver 6 thus supporting the shell. The bullet moves through the barrel and when it passes the hole in the barrel coinciding with the hole in actuating sleeve 3 pressure in the barrel passes to the floating power cylinder in actuating sleeve 3 causing piston 2 to press against stop 34. The pressure inside the floating power cylinder results in a force against part 4 of the actuating sleeve. As the actuating sleeve moves away from stop 34 the hole admitting the gas is sealed by the barrel thus trapping the gas under pressure in the floating power cylinder. The trapped gas in floating power cylinder expands and moves actuating sleeve 3 and 4 which are connected to breech block part 10 through pin 12. Breech block part 10 moves away from breech block part 15 carrying cam pin 14 thus rotating part 15 to such a position that locking lugs on the breech block part 15 are aligned to slots in receiver part 6, thus allowing the action to open. When the breech block parts 10 and 15 are in open position slots cut in the receiver 7 allow the lever type bolt catch 9 to drop into position between breech block parts 10 and 15. The breech block continues to move away from the barrel, compressing recoil spring 17, and extracting spent shell through exposed extractor port. The above-mentioned movement continues until actuating sleeve part 3 is stopped by shoulder on the barrel. This stops breech block 10 and 15 through pin 12 and second part of actuating sleeve 4. The recoil spring 17 pushes the breech block 15 and 10 back toward the barrel. During the breech block's travel back toward the barrel, parts 10 and 15 are held apart by bolt catch 9 thus preventing part 15 rotating when it pushes a new shell from the magazine into the barrel. The rear portion of actuating sleeve contacts the top of actuating lever 19 which moves automatic pawl 20 to rotate ratchet wheel thus firing the shell. The above cycle is repeated until all shells in the magazine are exhausted or the trigger is released in which case the trigger acts as a cam to rise the end of pawl 20 above ratchet wheel 23. The above cycle assumes that cams 22 and 28 are in a position that they do not contact pawls 24 and 20 respectively. Cam 22 is used as a safety to lift pawl 24 so that the end does not contact ratchet 23. When cam 22 is rotated about its axis it lifts pawl 24 as described above. Cam 28 is used to prevent continuous automatic action by lifting pawl 20 so that the end does not contact ratchet wheel 23.

When it is desired to produce a firearm that shoots in bursts the ratchet wheel is used as a counter by removing the ratchet wheel teeth at regular intervals. For example if a rifle is desired which will shoot in bursts of three, every third tooth of the ratchet wheel would be removed where pawl 20 contacts the racthet wheel.

The actuating sleeve functions as a reciprocating pump to circulate cooling air around the inside of the action through extractor port 79.

I claim:

1. A firearm having a cylindrical actuating sleeve concentric to the barrel consisting of a floating power cylinder attached to the actuating sleeve, having a cylindrical frame concentric to the barrel and being attached to a control mechanism consisting of a ratchet wheel counter actuated by levers and paws, having a cylindrical receiver mounted concentrically within the cylindrical actuating sleeve, a barrel mounted in the cylindrical receiver, a cylindrical breech block mounted concentrically within the cylindrical receiver and movable coaxially along the axis of the bore of the barrel, the breech block being connected to the receiver by two or more locking lugs and connected to the actuating sleeve by a pin, the breech blocking having a cam pin connecting the bolt and actuating sleeve and acting at a retainer for the firing pin, the breech block having a lever type bolt catch mounted on the breech block for preventing the breech block from rotating during feeding of a loaded shell from the magazine to the barrel.

* * * * *